United States Patent [19]

Holten

[11] Patent Number: 4,803,394

[45] Date of Patent: Feb. 7, 1989

[54] LAMP VESSEL FOR MULTIPLE LAMP TYPES

[75] Inventor: Petrus A. J. Holten, Weert

[73] Assignee: U.S. Philips Corporation, New York, N.Y.

[21] Appl. No.: 22,160

[22] Filed: Mar. 5, 1987

[30] Foreign Application Priority Data

Feb. 25, 1987 [NL] Netherlands ..... 8700464

[51] Int. Cl.[4] ..... H01K 1/28; H01K 1/32

[52] U.S. Cl. ..... 313/113; 313/114; 362/302

[58] Field of Search ..... 313/113, 114, 115, 317; 362/302

[56] References Cited

U.S. PATENT DOCUMENTS

| | | | |
|---|---|---|---|
| 1,804,049 | 5/1931 | Claus | 313/115 |
| 2,110,590 | 3/1938 | Cook | 313/114 |
| 2,115,839 | 5/1938 | Briefer | 362/310 |
| 2,170,675 | 8/1939 | Ayral | 176/34 |
| 2,901,655 | 8/1959 | Linsday et al. | 313/113 |
| 4,041,344 | 8/1977 | Lagiusa | 313/113 |
| 4,633,126 | 12/1986 | Giller et al. | 313/113 |
| 4,656,386 | 4/1987 | Bloom et al. | 313/113 |
| 4,672,514 | 6/1987 | Giller | 362/297 |

FOREIGN PATENT DOCUMENTS 0022304 10/1982 European Pat. Off. .

*Primary Examiner*—David K. Moore
*Assistant Examiner*—Theodore C. Salindong
*Attorney, Agent, or Firm*—Brian J. Wieghaus

[57] ABSTRACT

The electric incandescent lamp has a blown glass lamp vessel having a neck-shaped wall portion, a parabolically curved wall portion which extends substantially transversely and a wall portion curved in accordance with an arc of a circle which extends substantially in the axial direction. A filament is arranged in a plane through the foci of the wall portion and at least partly coincides therewith. The electric incandescent lamp has the advantage that, independent of its finish it has a lamp vessel of the same shape and the same mounting means for the filament. The manufacture of incandescent lamps of different types is thereby simplified considerably.

9 Claims, 1 Drawing Sheet

LAMP VESSEL FOR MULTIPLE LAMP TYPES

BACKGROUND OF THE INVENTION

The invention relates to an electric incandescent lamp comprising a blown glass lamp vessel sealed in a vacuum-tight manner, having an axis of symmetry and a largest diameter transverse to the axis of symmetry. A neck-shaped first wall portion is behind the largest diameter and has a free end carrying a lamp cap having electric contacts. The lamp vessel has an internally concave second wall portion, and an internally concave wall portion which is substantially parabolically curved and which is a body of revolution of a parabola branch about the axis of symmetry, the parabola axis being remote from the axis of symmetry. An internally concave fourth wall portion is located opposite the lamp cap in front of the largest diameter. A helically wound filament is supported about the axis of symmetry substantially in a plane through the foci of the parabolically curved wall portion and at least partly coinciding with said foci, current-supply conductors interconnect the filament and contacts on the lamp cap.

The invention also relates to a blown glass bulb suitable for use in the lamp.

A lamp of this type is known from U.S. Pat. No. 2,110,590.

In the known lamp the parabolically curved wall portion is formed in such a way that its shape can be described as being produced by intersecting the parabola along its axis, spacing the halves apart from each other and subsequently jointly revolving them around the axis of symmetry. As a result, the lamp vessel is wider at the same curvature of the wall portion. The lamp vessel is elliptically curved from the plane through the foci located on a circle to the neck-shaped wall portion.

The known lamp provides a solution to the problem of parabolic reflectors being too narrow in the focal plane if the filament is to be mounted in a deep reflector so as to obtain a satisfactory beam of generated light without the transverse dimensions of the lamp exceeding a conventional size.

Although in the known lamp the branches of the parabola are moved apart in an axial cross-section, the filament is still in the focal plane in a narrow portion of the lamp vessel, far remote from the largest diameter of the lamp vessel. A drawback of the known lamp therefore is that only filaments consuming a relatively low power can be mounted in the lamp vessel in order to avoid overheating of the lamp vessel.

Electric lamps having a power value between 15 and 100 W, for example 15, 25, 40, 60, 75 and 100 W intended to be operated at a standard voltage are manufactured in a large number of types. The finish, the coating or the processing, of the lamp vessel wall, and also its shape and the size and shape of the inner parts of the lamp are different.

The electric incandescent lamps for operation at the mains voltage in the said power range include:

lamps such as those described in the above-cited U.S. Pat. No. 2,110,590, having a mirror-coated parabolically curved wall portion opposite to which a window is located. The window is glazed (is slightly light-scattering) for example due to an etching treatment and/or is colored;

lamps having a substantially spherical lamp bulb which is transparent or is frosted or which is coated with a white or colored light-scattering layer;

lamps having a conical wall portion adjacent to, and a curved wall portion opposite to the neck-shaped wall portion, the conical wall portion being provided with a white or coloured light-scattering layer and the curved wall portion being slightly light-scattering and possibly colored. These lamps emit light on all sides, but supply along the axis in directions remote from the neck-shaped wall portion a higher luminous intensity than in other directions;

lamps having opposite to the neck-shaped wall portion a spherical wall portion which is mirror-coated or is provided, for example with a white light-scattering coating.

The manufacture of this large number of lamp types is very complicated due to the variety of lamp vessel types which require on and between the production machinery their own supply and lead-out mechanisms and their own transport means, and which moreover require individual packaging. The readjustment of production machines from one lamp type to the other is thus a very laborious operation. Another complication of their manufacture is that the various types of lamps require different filament supports.

SUMMARY OF THE INVENTION

It is an object of the invention to provide an electric incandescent lamp having a blown glass lamp vessel shaped in such a way that this lamp vessel may have a coating or optional processing operation for realising a lamp from a variety of different types. It is also an object of the invention to provide a blown glass bulb suitable for use in such an electric incandescent lamp.

In the lamp according to the invention, the axis of symmetry is located between the parabola branch and the parabola axis at the parabolically curved second wall portion. When viewed in axial cross-section the parabolically curved wall portion extends mainly in the transverse direction between the neck-shaped wall portion and the largest diameter of the lamp vessel. The third wall portion is substantially curved in accordance with a circular arc and extends mainly in the axial direction in front of the largest diameter. The center of curvature is located on the other side of the axis of symmetry in an axial region extending to the rear from the plane through the foci of the parabolically curved wall portion. The wall portion, adjacent the largest diameter, gradually merges into the parabolically curved wall portion.

The filament is arranged in an axial region which extends on either side of the largest diameter.

Unlike the lamp described in the above-cited U.S. Pat. No. 2,110,590, the shape of the parabolically curved wall portion may be considered to be produced by axially intersecting a parabola, by moving the halves partly over each other and by revolving the whole. The axis of symmetry thus lies in between the branch of a parabola and its axis.

In axial cross-section the parabolically curved wall portion extends mainly in the transverse direction, which implies the use of a parabola having a relatively large focal length. Consequently, the lamp vessel widens out considerably from the neck-shaped portion, preventing overheating of the wall. This has great advantages. At a largest diameter of approximately 60 mm, which is also conventional for commercial lamps using a low power (for example 25 W), it is possible to incorporate filaments using a relatively high power (for example 75 or 100 W) due to their central positioning in the lamp vessel.

BRIEF DESCRIPTION OF THE DRAWINGS

The invention will now be described in greater detail with reference to the accompanying drawings which show embodiments of the lamp according to the invention.

In the drawing.

DESCRIPTION OF THE PREFERRED EMBODIMENT

Figure 1:
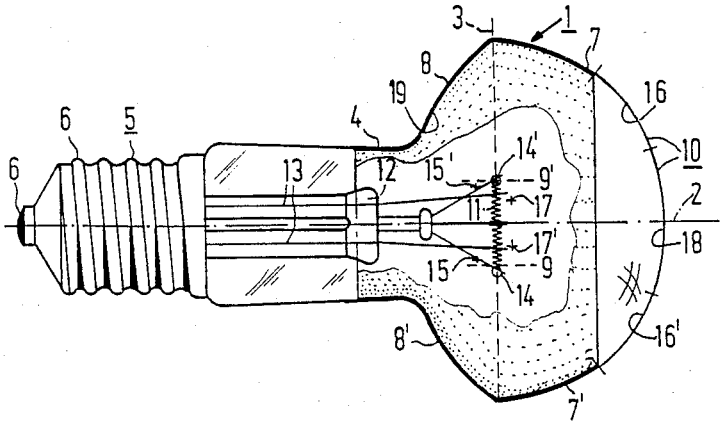
FIG. 1 is a side elevation of a first embodiment of a lamp with the lamp vessel in axial cross-section.

In FIG. 1 the electric incandescent lamp has a blown glass lamp vessel 1 which is sealed in a vacuum-tight manner and which has an axis of symmetry 2. A largest diameter 3 transverse to the axis of symmetry and a neck-shaped first wall portion 4 behind the largest diameter 3. The free end of the neck-shaped wall portion 4 carries a lamp cap 5 which has electric contacts 6. The lamp vessel 1 also has an internally concave third wall portion 7, 7', an internally concave wall portion 8, 8' which is substantially parabolically curved second and which is a body of revolution of a parabola branch about the axis of symmetry 2. The parabola axis 9, 9' are displaced from the axis of symmetry 2. An internally concave fourth wall portion 10 is located opposite the lamp cap 5 in front of the largest diameter 3. A helically wound filament 11 is arranged around the axis of symmetry substantially in a plane through the foci 14, 14' of the parabolically curved wall portion 8, 8', at least partly coinciding with these foci 14, 14'. In the Figure the plane through the foci 14, 14' coincides with the largest diameter 3. The lamp has means 12 to keep the filament positioned and current supply conductors 13 which interconnect the filament 11 and contacts 6 on the lamp cap 5.

The axis of symmetry 2 lies between the parabola branch 8, 8' and the parabola axis 9, 9' at the parabolically curved wall portion 8, 8'. The parabolically curved wall portion 8, 8' extends away from the lamp base mainly in a transverse direction between the neck-shaped wall portion 4 and the largest diameter 3. The dimensions of the lamp vessel 1 from the neck-shaped wall portion to the largest diameter 3 increase to a greater extent in the transverse direction than in the axial direction.

The third wall portion 7, 7' is curved substantially in accordance with an arc of a circle and extends mainly in the axial direction in front of the largest diameter 3. The second wall portion extends away from the from the largest diameter 3 to a greater extent in the axial direction than it decreases in the transverse direction. The wall portion 7 has a center of curvature 15 which is located on the other side of the axis of symmetry 2 in an axial region which extends towards the neck shaped wall portion from the plane through the foci 14, 14' of the parabolically curved second wall portion 8, 8'. The center of curvature 15, 15' of the third wall portion 7,7' is located behind the plane through the foci 14, 14'. Adjacent the largest diameter 3 the wall portion 7, 7' gradually merges into the parabolically curved wall portion 8, 8'.

The filament 11 is arranged in an axial region which extends on either side of the largest diameter and adjacent the largest diameter 3 in the Figure.

In a favorable embodiment the fourth wall portion is curved in a circular arc in an annular zone remote from the axis of symmetry, the center of curvature being located proximate to the axis of symmetry and in front of the filament. This embodiment has the advantage that the lamp may be in the form of a bowl-mirror lamp. In that case the lamp has a reflective coating on a wall portion in front of the filament. Such a lamp may alternatively have, for example a white partly reflective, partly light-transparent coating on said wall portion.

FIG. 1 shows this shape. The fourth wall portion 10 has an annular zone 16, 16' remote from the axis of symmetry 2 in which the wall portion in the axial cross-section is substantially curved in accordance with an arc of a circle. The center of curvature 17 of the zone 16 is located proximate to the axis of symmetry 2 and in front of the filament 11. In the region 18 in the immediate proximity of the axis 2 the fourth wall portion 10 may have a larger radius of curvature, or it may be ogive. In FIG. 1 a reflective coating with, for example aluminium, silver, copper/aluminium, or gold is denoted by the reference numeral 19. The Figure shows that the filament 11 is at a relatively large distance from the wall of the lamp vessel 1 in all directions, at the largest diameter 3.

A lamp vessel of the same shape as in FIG. 1 may be entirely transparent or substantially frosted. Alternatively this lamp vessel may have a light-scattering coating possibly comprising a white or colored pigment. In a special embodiment this lamp vessel 1 has a white light-scattering coating on the wall portions 4, 8, 8' and 7, 7' and the wall portion 10 is glazed or has a coating which is not pigmented or is pigmented to a slight extent. In that case the lamp emits more light in the forward direction, in directions which extend at a relatively small angle to the axis 2, than when the entire lamp vessel is provided with the same coating. The lamp has a smaller lateral luminance. In all these embodiments the same stem 13 can be used to keep the filament 11 positioned.

It is of special importance that the same means and the same stem can be used to keep the same filament positioned, also when constructing the lamp according to the invention as a reflector lamp.

The lamp shown in FIG. 1 throws a part of the generatred light directly to the exterior through the wall portion 10 functioning as a window. Another part of the light is incident on the mirror-coated wall portion 7, 7'. This portion prevents emission of this light at large angles to the axis 2. The incident light is reflected to the mirror-coated wall portion 8', 8 which throws the major part of the light through the window 10 to the exterior. Light which is thrown directly onto the wall portion 8, 8' emanates for the greater part through this window 10.

The invention also relates to a blown glass bulb suitable for use in the electric incandescent lamp according to the invention. An important property of the bulb is that it is mechanically strong. The bulb is therefore suitable to be evacuated for manufacturing vacuum lamps or for the manufacture of mirror coatings.

Figure 2:
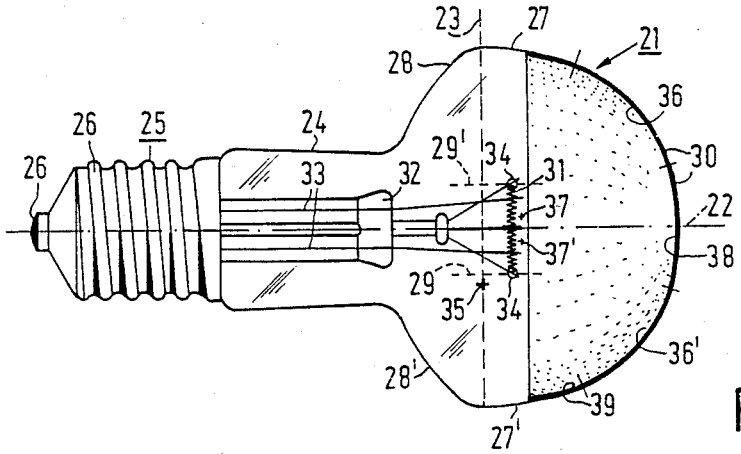
FIG. 2 is a modification of FIG. 1 in axial cross-section.

In FIG. 2, parts corresponding to those of FIG. 1 have a reference numeral which is 20 higher. The third wall portion 27, 27' and the fourth wall portion 30 are mirror coated with a layer 39. The lamp is a bowl-mirror lamp suitable to co-operate with an external reflector. The parabola of the wall portion 28, 28' has a larger focal length (f=21 mm) than that of wall portion 8, 8' of FIG. 1 (f=19 mm). Consequently, the filament 31 is located in front of the largest diameter 23 and in its proximity in a central position in the lamp vessel.

In one embodiment of the lamp according to the invention the parabolically curved wall portion has a relief in a zone in the proximity of the neck-shaped wall portion. The wall portion may be roughened, frosted or glazed in this zone. On the other hand, a ripple may be superimposed on the wall portion in axial cross-section. The amplitude thereof may decrease with an increasing distance to the neck-shaped wall portion. Such a relief can homogenize the luminous intensity in the light beam of the lamp in its reflector design. A ripple superimposed on the third wall portion is desirable because it can be formed on the bulb while blowing it.

Figure 3:
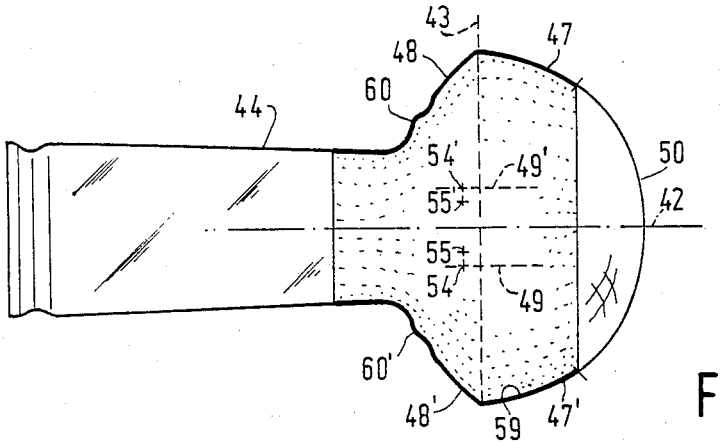
FIG. 3 is a blown glass bulb suitable for use in a further modification of FIG. 1 in axial cross-section.

In FIG. 3, parts corresponding to those of FIG. 2 have a reference numeral which is 20 higher than in FIG. 2. The focal length of the wall portion 48, 48' is smaller (f=17 mm) than that of wall portion 8, 8' of FIG. 1. The foci 54, 54' are located behind the largest diameter 43, but in its proximity. The filament which is to be arranged in that area is sufficiently remote from the wall of the lamp vessel to prevent overheating.

The parabolically curved wall portion 48, 48' has a relief in a zone in the proximity of the neck-shaped wall portion 44. A ripple 60, 60' having an amplitude which decreases with an increasing distance to the neck-shaped wall portion 44 is superimposed on the wall portion 48, 48'. The center of curvature 55, 55' of the third wall portion 47, 47' is located in a transverse plane through the foci 54, 54', respectively.

The filament may be arranged in various shapes, for example substantially as an open circle or along three sides of an isosceles trapezium.

A lamp according to FIG. 1 which consumed a power of 60 W at 225 V had a filament which was arranged along four sides of an equilateral pentagon. The lamp produced a light beam having a center value of 925 cd (candela) and a beam width of 2×15°. A commercial reflector lamp of the same power produces a light beam with a center value of 800 cd and a beam width of 2×15°. Furthermore the luminous flux in the beam of the lamp according to the invention is 30% higher than that of the said commercial lamp.

A lamp having the shape as shown in FIG. 2 but with a mirror coating on the wall portions 27, 27' and 28, 28' instead of the mirror coating 39 shown also consumed a power of 60 W at 225 V. A filament was arranged in the same geometry. The lamp produced a light beam having a center value of 900 cd and a beam width of 2×16°. Furthermore the luminous flux in the beam of the lamp according to the invention is 30% higher than that of the known commercial lamp.

An electric incandescent lamp also having mirror-coated co-operating wall portions is known from GB corresponding to U.S. Pat. No. 4,506,185. A mirror-coated wall portion widening considerably in the proximity of the neck of the lamp vessel is a paraboloid in that lamp. A mirror-coated spherical wall portion is located opposite to it. These two wall portions are connected by an annular wall portion extending in a substantially transversal direction. The known lamp combines the functions which are normally fulfilled by a bowl-mirror lamp together with an external paraboloidal reflector. The spherical reflector throws light on the paraboloidal reflector which throws the light to the exterior.

The known lamp has a number of drawbacks. The filament is arranged at the largest diameter of the lamp vessel, and is surrounded by the spherical wall portion which is located close to it. Consequently the lamp can only comprise filaments using a relatively low power. The spherical wall portion throws light on the paraboloidal mirror-coated wall portion but also screens off a considerable part of this wall portion, the more so because the spherical wall portion must be relatively voluminous from a thermal point of view. Finally, due to its shape the known lamp vessel is mechanically relatively weak.

What is claimed is:

1. A symmetrical lamp envelope having an axis of symmetry, comprising:

(a) a neck shaped first portion:

(b) an internally concave second portion extending outwardly from said necked shaped portion and terminating at the largest diameter of said lamp envelope, said second portion extending more in a direction transverse to said axes of symmetry than along said axis, said second portion being a body of revolution of a parabola branch about said lamp envelope axis of symmetry, the axis of symmetry being between said parabola branch and the focus of said second branch, said parabolic portion having a locus of foci in a plane transverse to said axis of symmetry;

(c) an internally concave third portion smoothly merging with said second portion at said largest diameter and extending away from said largest diameter more along the axis of symmetry than transverse to said axis of symmetry, said third portion being a body of revolution of a circular arc about said axis of symmetry, the axis of symmetry lying between the center of curvature of said circular arc and said circular arc, said center of curvature lying in a region which extends from said locus of foci towards said neck portion; and (d) an internally concave fourth wall portion opposite said first and second portions smoothly joining said third portion.

2. A lamp envelope as claimed in claim 1, wherein said fourth wall portion comprises a body of revolution of a second circular arc about said axis of symmetry, the center of curvature of said second circular arc being located proximate to the axis of symmetry and in a region extending from said locus of foci to said fourth wall portion.

3. A lamp envelope as claimed in claim 1 wherein said center of curvature of said third wall portion and said foci of said parabolic second portion are coplanar.

4. A lamp envelope as claimed in claim 1, wherein said lamp envelope comprises a relief in an annular zone in said parabolic second wall portion.

5. An incandescent lamp, comprising:

(a) a symmetrical lamp envelope having an axis of symmetry comprising a neck shaped first portion, an internally concave second portion extending outwardly from said necked shaped poriton and terminating at the largest diameter of said lamp envelope, said second portion extending more in a direction transverse to said axes of symmetry than along said axis, said second portion being a body of revolution of a parabola branch about said lamp envelope axis of symmetry, the axis of symmetry being between said parabola branch and the focus of said parabola branch, said second portion having a locus of foci in a plane transverse to said axis of symmetry, an internally concave third portion smoothly merging with said second portion at said largest diameter and extending away from said largest diameter more along the axis of symmetry than transverse to said axis of symmetry, said third portion being a body of revolution of a circular arc about said axis of symmetry, the axis of symmetry lying between the center of curvature of said circular arc and said circular arc, said center of curvature lying in a region which extends from said locus of foci towards said neck portion, and an internally concave fourth wall portion opposite said first and second portions smoothly joining said third portion;

(b) a lamp base secured on said neck portion;

(c) a filament energizable for emitting light; and (d) means for supporting said filament within said envelope with a portion of said filament coinciding with said foci of said parabolic portion.

6. An incandescent lamp as claimed in claim 5, wherein said fourth wall portion comprises a body of revolution of a second circular arc about said axis of symmetry, the center of curvature of said second circular arc being located proximate to the axis of symmetry and in a region extending from said locus of foci to said fourth wall portion.

7. An incandescent lamp as claimed in claim 6, wherein said parabolic second wall portion further comprises a ripple in an annular zone about said axis of symmetry, the amplitude of said ripple decreasing away from said neck shaped wall portion.

8. An incandescent lamp as claimed in claim 6, wherein said fourth portion and part of said third portion adjacent said fourth portion have a mirror coating so that light from said filament is directed through said parabolic second portion.

9. An incandescent lamp as claimed in claim 5, wherein said envelope has a reflective coating on said parabolic second portion and said third portion so that light is directed out of the lamp envelope through said fourth portion.

* * * * *